US009410389B2

(12) United States Patent
Fanini et al.

(10) Patent No.: US 9,410,389 B2
(45) Date of Patent: Aug. 9, 2016

(54) SELF-CLEANING FLUID JET FOR DOWNHOLE CUTTING OPERATIONS

(71) Applicant: Baker Hughes Incorporated, Houston, TX (US)

(72) Inventors: Otto N. Fanini, Houston, TX (US); Karsten Fuhst, Giesen (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 519 days.

(21) Appl. No.: 13/758,283

(22) Filed: Feb. 4, 2013

(65) Prior Publication Data

US 2014/0138083 A1 May 22, 2014

Related U.S. Application Data

(63) Continuation-in-part of application No. 13/681,673, filed on Nov. 20, 2012.

(51) Int. Cl.
*E21B 29/00* (2006.01)
*E21B 49/06* (2006.01)

(52) U.S. Cl.
CPC ..... *E21B 29/002* (2013.01); *E21B 29/00* (2013.01); *E21B 49/06* (2013.01)

(58) Field of Classification Search
CPC ..... E21B 29/002; E21B 49/06; E21B 29/005; E21B 10/60; E21B 10/602; E21B 29/00
See application file for complete search history.

(56) References Cited

U.S. PATENT DOCUMENTS

| | | | | |
|---|---|---|---|---|
| 2,482,674 | A | 9/1949 | Kreigel | |
| 5,539,985 | A | 7/1996 | Wershe | |
| 5,862,870 | A | 1/1999 | Hutchinson | |
| 6,527,065 | B1 * | 3/2003 | Tibbitts | E21B 10/43 175/339 |
| 6,581,859 | B2 | 6/2003 | Adams et al. | |
| 7,574,807 | B1 | 8/2009 | Fuller et al. | |
| 7,575,056 | B2 | 8/2009 | Fuhst et al. | |
| 7,909,100 | B2 | 3/2011 | Bryant, Jr. et al. | |
| 7,987,901 | B2 | 8/2011 | Krueger et al. | |
| 2007/0131410 | A1 | 6/2007 | Hill et al. | |
| 2010/0065264 | A1 | 3/2010 | Nackerud | |
| 2010/0307738 | A1 | 12/2010 | Mouget et al. | |
| 2011/0000668 | A1 * | 1/2011 | Tunget | 166/285 |
| 2011/0192589 | A1 | 8/2011 | Fuhst et al. | |
| 2011/0290487 | A1 | 12/2011 | Perschke et al. | |
| 2012/0217005 | A1 | 8/2012 | Gupta | |
| 2012/0318579 | A1 | 12/2012 | Yang et al. | |
| 2015/0060040 | A1 * | 3/2015 | Ruttley | 166/55.1 |

OTHER PUBLICATIONS

For the American Heritage Dictionary definition: cupola. (n.d.) American Heritage® Dictionary of the English Language, Fifth Edition. (2011). Retrieved Jun. 26, 2015 from http://www.thefreedictionary.com/cupola.*

* cited by examiner

*Primary Examiner* — Blake Michener
*Assistant Examiner* — Wei Wang
(74) *Attorney, Agent, or Firm* — Shawn Hunter

(57) ABSTRACT

Devices and methods for cutting a workpiece. A cutter is provided with a fluid jet generator that creates and projects a jet of fluid proximate the cut being made in a workpiece.

9 Claims, 14 Drawing Sheets

SELF-CLEANING FLUID JET FOR DOWNHOLE CUTTING OPERATIONS

BACKGROUND OF THE INVENTION

1. Field of the Invention

The invention relates generally to cutting devices useful for cutting tubular and structural members, such as those in a subsea environment immersed in fluids or a downhole or subsurface applications involving structural and operational control, formation evaluation and monitoring members. The invention also relates generally to cutters used for cutting core samples and drilling in wellbore walls.

2. Description of the Related Art

Pipe cutters are used to cut tubular members. Pipe cutters typically include a circular cutting blade that is mounted upon a spindle. The spindle, in turn, is mounted upon an arm that can be moved radially out through a slot in a surrounding housing to be brought into cutting contact with a surrounding tubular member to be cut. During cutting, the blade can rotate at approximately 1000 rpm. Pipe cutters are often used downhole, being run in on a tool string to cut a casing member within a wellbore. Commercially available pipe cutters include the MPC Mechanical Pipe Cutter from Baker Hughes Incorporated of Houston, Tex.

In operation, the pipe cutter is disposed within a tubular member to be cut, and the cutting blade is rotated by a motor. The supporting arm is then moved so that the cutting blade is placed in cutting contact with the tubular member. The pipe cutter also rotates about it central axis, causing a circumferential cut to be made in the surrounding tubular member.

Cuttings or filings create a problem during cutting. They can cause damage to the cutting blade or prevent a clean cut from being made. Efficiency of a pipe cutting operation is affected by materials accumulated and packed in the cutting groove. As a cut is made deeper, the cuttings can become trapped within the cut, magnifying associated operational efficiency deterioration and wear and tear problems.

Piping and well structural members used today are made of progressively harder materials, and this makes pipe cutting performance more challenging. During pipe cutting operations, it has been noticed that random and unpredictable torque load fluctuations at times can lock the cutting blade into the pipe, requiring continuous cutting parameters (e.g., torque load, RPM, feed rate, electrical or hydraulic power consumption, cutting efficiency, equipment temperatures, etc.) monitoring and adjustments to reduce the operational frequency of cut interruptions. Cutting adjustments and interruptions lower operational efficiency by increasing cutting time, lower energy cut efficiency and increasing wear and tear in the cutting elements and power drive train. These variations in cutting torque load and cutting advancement rate often requires real time adjustments to the cutting controls due to the equipment's input power constraints available, strength limitations of the cutting elements such as blade or coring bit, cutting edge materials endurance and abrasion wear resistance due to the cutting action, limitations of the power drive providing rotation action such as electrical motor or hydraulic pump, thermal generation and dissipations of the equipment assembly characteristics in the operating temperature, etc. These load and cutting rate variations are amplified and aggravated by cuttings and debris accumulated in the cutting groove during the cutting operation resulting in reduced cutting energy utilization efficiency, reduced cutting productivity (i.e. cutting rate reduction or interruption), increased cutting equipment wear and tear, higher maintenance costs, frequency and effort, increased difficulty and even impediment to cutting thicker pipes with harder specialty alloys for example.

Sidewall coring cutters are used to cut cylindrical coring samples in the wall of a wellbore. These coring cutters are also prone to problems relating to cutting or filings as these tend to prevent a clean cut from being made and/or cause damage to the cutter.

SUMMARY OF THE INVENTION

The invention provides systems and methods for cleaning or removing cuttings from a cut in a workpiece as cutting is being performed. In a described embodiment, a downhole pipe cutter includes devices and methods that create one or more fluid jets proximate a cut that aids in cleaning cuttings and debris from the cut as it is being made. This invention is applicable to mechanical cutting devices operating from inside or outside of tubulars or pipes immersed in environments that include fluids and where the surrounding immersion fluid is used in the jet cleaning action. The cleaning fluid flow is directed to and around the cutting edge. Cutting equipment solutions benefitting from this invention are utilized in the oilfield, utilities installations, chemical transportation, storage and environmental protection operations. Environmental protection operations are often triggered by regulatory compliance requirement. Specific situations addressed by this invention involve subsea installations or environments immersed in fluids or downhole (subsurface) cutting applications involving cutting of structural and operational monitoring and control members involving material recovery (re-use, re-manufacturing or re-processing equipment parts) or modification of permanent or temporary downhole subsurface installations. Operational monitoring and control members can involve mechanical inkages, electrical monitoring and control and power lines or hydraulic power and control lines used for remote or automated control cutting sequences The cutting operations can be part of a pipe recovery operation, reservoir's well production completion modification and reservoir's well production recovery adjustments and optimization, temporary or permanent downhole reservoir production installations, production packer's recovery, removal of equipment for salvage and recycling for future installation or re-use deployments, or well abandonment operations required by regulatory legislation. Optionally, the cutting operations can be part of multiple sequence steps involving the removal (with or without recovery recycling) and replacement of structural, monitoring or control members associated with reservoir's well production completion modification and reservoir's well production recovery adjustments and optimization. Recovery and recycling of subsea and downhole members can involve pipes, valves, flow control, or packers used for reservoir producing zone isolation along the wellbore. The figures shown teach jet creation for a rotating flat circular cutter, but the invention is also applicable to a rotating cutter with cylindrical geometry as used for formation core sample cutting where the jet forming features described herein are placed in the backside of the cylindrical cutting blade and the active cutting edge is in the leading edge of the cylindrical cutter. Cylindrical rotating cutters for collecting formation core samples can be deployed against the borehole wall or along the borehole longitudinal axis along the drilling bit path.

In a first particular embodiment, a pipe cutter is provided with a fluid housing that is mounted proximate the cutting blade. In a current embodiment, the housing has a generally circular configuration with a diameter that is smaller than the diameter of the cutting blade. The exemplary fluid housing defines a central chamber having a central fluid inlet and a radial fluid jet outlet. In a described embodiment, the fluid housing includes a raised cupola.

In a described embodiment, an impeller blade assembly is secured to or rotates with the cutting blade and rotates within the central chamber of the fluid housing. In a described embodiment, the impeller blade assembly is a multiple stage blade assembly in that there is a set of blades located adjacent another set of blades. The use of at least two stages improves fluid flow through the fluid housing. An upper, reduced-diameter stage draws fluid into the central chamber in an axial direction. A lower, enlarged-diameter stage flows fluid radially outwardly toward the fluid jet outlet. Also in a described embodiment, the impeller blade assembly has curved blades.

In operation, rotation of the cutting blade during a cutting operation also rotates the impeller blade assembly. A cleaning fluid jet is created and directed toward and around the active cut area being made as fluid entering the fluid chamber from the fluid inlet is flowed outwardly through the fluid outlet. The fluid jet is also created by the impeller blade assembly as rotation increases the flow rate of fluid exiting the chamber through the fluid outlet.

In a second particular embodiment, a fluid collector and compressor assembly is attached to or rotates with the cutting blade. In a described embodiment, the fluid collector and compressor assembly includes one or more fluid collector/compressors that use the rotational motion of the cutting blade to accumulate fluid within their fluid chambers and provide fluid jets directed toward the area of the cut.

In a particular embodiment, there are four such collector/compressors in the form of four lobes that collect fluid into a fluid chamber and expel fluid in the direction of the cut. Each collector/compressor lobe preferably has a fluid inlet and a fluid outlet. In specific embodiments, the fluid inlets have larger flow areas than the fluid outlets, thereby allowing fluid velocity to be increased by passing through the collector/compressor. In a described embodiment, the fluid inlet is an opening that is open along a line that is normal to the radius of the cutting blade. The fluid outlet is directed radially outwardly and toward the cut being made. Additional embodiments include collector/compressor lobes on an opposite axial side of the blade that direct fluid away from the cut being made so that fluid will flow through the cut being made to help remove cuttings.

In operation, fluid within the surrounding tubular is collected and flowed toward a cut being made by the collector/compressors. Rotation of the cutting blade together with the collector and compressor assembly will cause fluid to be flowed through the fluid inlets and into the fluid chambers of the collector/compressors. The fluid will then be flowed radially outwardly in the direction of the cut under the impetus of centrifugal force.

Embodiments of the present invention are also described wherein fluid jet generators are incorporated into sidewall coring cutting devices having generally cylindrical cutting blades. In one embodiment, a core cutting blade is provided with a plurality of collector/compressors in the form of lobes that collect fluid into a fluid chamber and expel fluid in the direction of the cut. In the described embodiment, there are lobes located in both the radial interior of the core cutting blade and the radial exterior of the core cutting blade. In an alternative embodiment, curved or angled fins are used to propagate fluid jets in the direction of the cut. In another alternative embodiment, an independent jet forming component is retained within the radial interior of the coring cutter. In a described embodiment, the independent jet forming component includes a central axial shaft with a plurality of radially outwardly-extending spokes, each of the spokes carrying a jet forming mechanism, such as a lobe or fin of the types described previously. In a described embodiment, the jet forming component is rotated independently of the core cutting blade to generate fluid jets that are directed toward the cut being made. In other embodiments, additional fluid jet generating components are used to create fluid jets that flow fluid away from a cut being made so that fluid will flow through the cut being made and help remove cuttings.

Cutting operational methods involve automated cutting control sequences and continuous adjustments. This invention enables an improved cutting operation outlined in the following steps: Positioning the downhole tool in a wellbore extending into the subterranean formation, checking the equipment operational status and environmental conditions before and during cutting operation, commencing cutting operations by rotating a cutting element of the downhole tool and extending the rotating cutting element towards the cutting target and apply force for cutting action with a forced cleaning fluid flow, sensing at least a parameter associated with the cutting operations, and adjusting the cutting operation based on the sensed parameters. Downhole cutting adjustments could be made concurrently with adjustments made in the surface power sources in a well defined cutting protocol sequence algorithm. Surface power source level could be increased as cutting loads increase due to the cutting process and adjustments or conversely reduce surface power source level as cutting loads decrease with associated cutting adjustments. The forced fluid cleaning flow improves the cutting operational efficiency and productivity. The cutting elements and equipment field service operational durability is improved by the forced fluid cleaning flow resulting in less wear and tear of the cutting elements, cleaner cutting groove, less intense cutting operational adjustments, less frequent, more stable, operationally more robust and easier to implement.

The directed cleaning fluid flow results in a cleaner cutting groove during the cutting operations enabling the following cutting advantages: The random and unpredictable torque load fluctuations that at times can lock the cutting blade or cutting element into the pipe are reduced, continuous cutting parameters (e.g. torque load, RPM, feed rate, electrical or hydraulic power consumption, cutting efficiency, equipment temperatures, etc.) monitoring lead to less adjustments allowing improved operational frequency and less cut interruptions, reduced cutting adjustments and interruptions improve operational efficiency by shortening cutting time, increasing energy cut efficiency and lowering wear and tear of the cutting elements and power drive train.

These reduced load variations in both cutting torque load and cutting advancement rate due to cleaner grooves often requires less real time adjustments to the cutting controls driven by the following considerations: equipment's input power constraints available, strength limitations of the cutting elements such as blade or coring bit, cutting edge materials endurance and abrasion wear resistance due to the cutting action, limitations of the power drive providing cutting rotation action such as electrical motor or hydraulic pump, thermal generation and dissipations of the equipment assembly characteristics in the operating temperature, etc. . . . These load and cutting rate variations are reduced by the cleaning and removal of cuttings and debris accumulated in the cutting groove during the cutting operation resulting in the improvement of the cutting energy utilization efficiency, increased cutting productivity (Le, cutting rate reduction or interruption), reduction in cutting equipment wear and tear, lower maintenance costs, frequency and effort, reduced difficulty for cutting thicker pipes with harder specialty alloys for example. In dry wells a forced cleaning fluid jet can be dispensed from a tool's internal fluid container supply.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
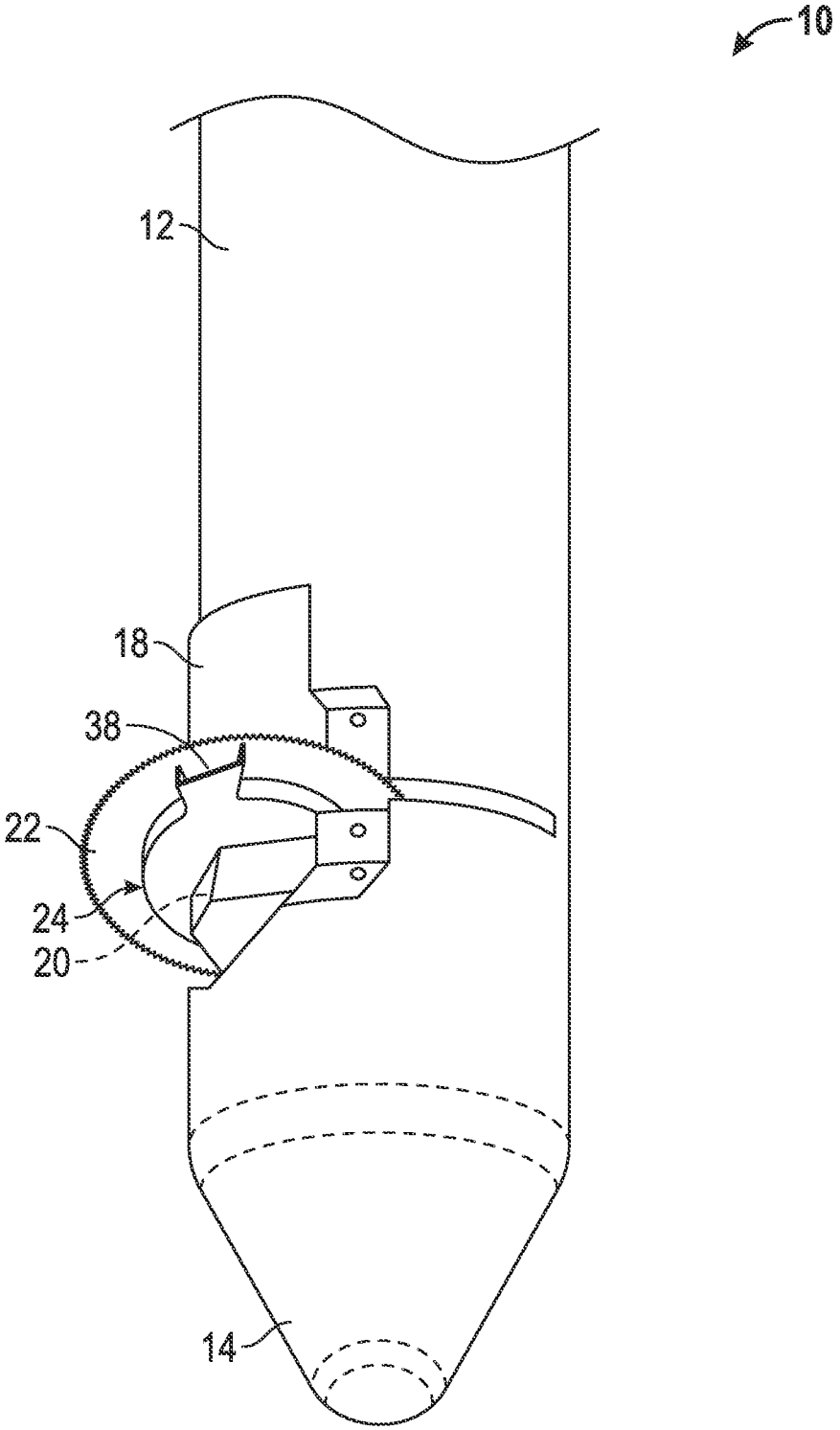
FIG. 1 is an external isometric view of an exemplary pipe cutter which incorporates an exemplary fluid jet forming arrangement in accordance with the present invention.
Figure 2:
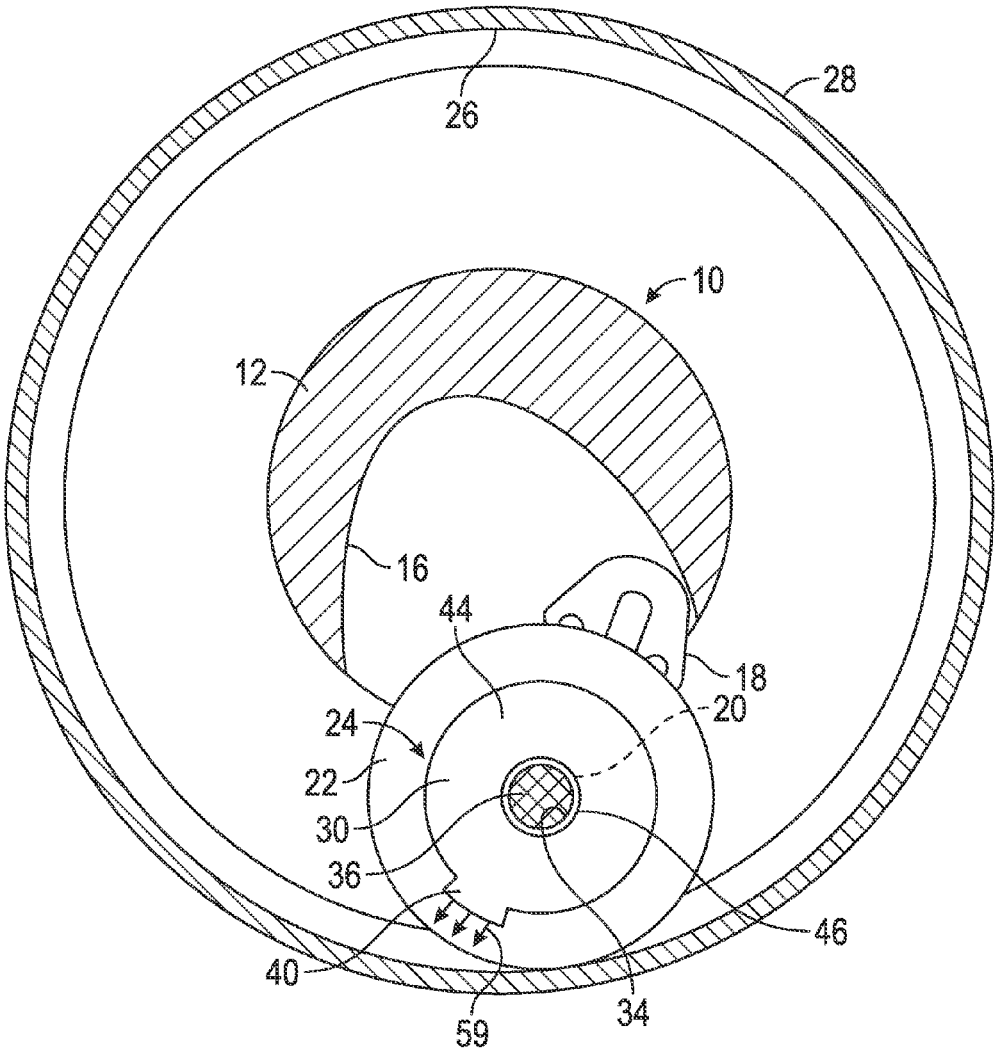
FIG. 2 is a cross-sectional cutaway view of the pipe cutter shown in FIG. 1.
Figure 3:
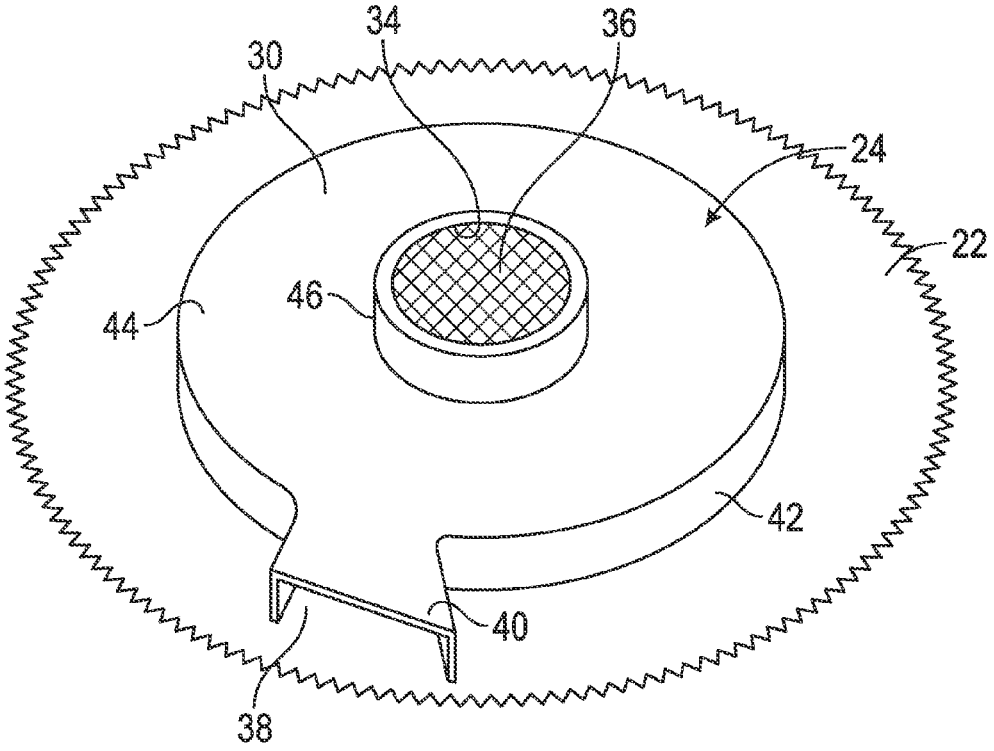
FIG. 3 is an external isometric view of components of the fluid jet generator used in the pipe cutter shown in FIGS. 1 and 2.

FIG. 1 depicts an exemplary pipe cutter 10 which is used to cut tubular members. The pipe cutter 10 generally includes a tubular cutter housing 12 having a tapered nose portion 14. The housing 12 is shaped and sized to be disposed within a tubular member that is to be cut. As can be seen with reference to FIG. 2, a cavity 16 is defined within the housing 12. The cavity 16 is shaped and sized to retain within a support arm 18 which carries a rotary spindle 20 as well as a flat, circular cutting blade 22. A circular cutting blade 22 is mounted upon the spindle 20 and can be rotated by a motor (not shown) contained within the pipe cutter 10 in a manner known in the art. The support arm 18 is articulable so that the cutting blade 22 can be moved into or out of the cavity 16 during a cutting operation.

The pipe cutter 10 is provided with a fluid jet generator, generally indicated at 24, that is used to create a fluid jet that will aid in removing cuttings and debris from a cut 26 that is being made in a surrounding tubular pipe 28. The fluid jet generator 24 includes a fluid housing 30 that is generally dome-shaped and preferably provides a generally circular cross-section. The fluid housing 30 defines an interior fluid chamber 32 (see FIG. 4). A fluid inlet 34 is disposed through the housing 30 to permit fluid within the surrounding pipe 28 to flow into the fluid chamber 32. A screen 36 is preferably provided within the fluid inlet 34 in order to prevent debris within the pipe 28 from entering the fluid chamber 32. A fluid outlet 38 is provided along a radial side of the fluid housing 30. Preferably, the fluid outlet 38 is disposed through a radial projection or arm 40 that extends radially outwardly from the outer circumference 42 of the fluid housing 30. In a particular embodiment, the fluid housing 30 presents a substantially planar top plate 44 with a central raised cupola 46.

Figure 4:
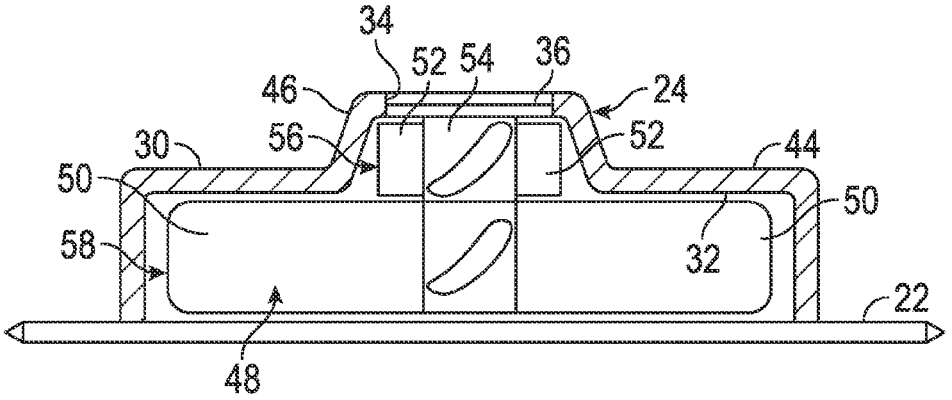
FIG. 4 is a side, cross-sectional view of the fluid jet generator shown in FIG. 3.
Figure 5:
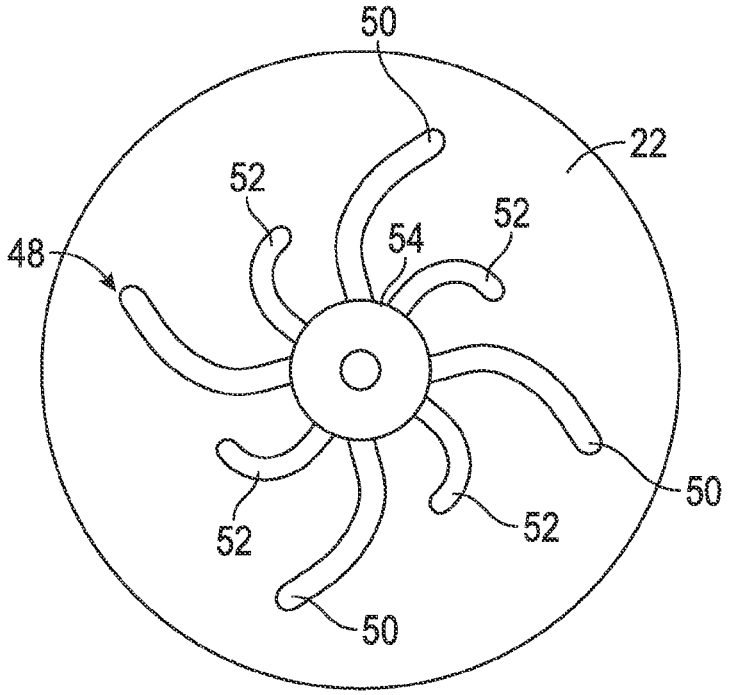
FIG. 5 is a top view of interior portions of the fluid jet generator shown in FIGS. 3 and 4.

An impeller blade assembly, generally indicated at 48, is located within the fluid chamber 32. The impeller blade assembly 48 is visible in FIGS. 4 and 5. The impeller blade assembly 48 is affixed to or rotates with the cutting blade 22. In the depicted embodiment, the cutting blade 22 and the impeller blade assembly 48 rotate in a counter-clockwise direction. In one embodiment, the impeller blade assembly 48 includes a plurality of long blades 50 and shorter blades 52 that extend radially outwardly from a central hub 54. The blades 50, 52 are preferably curved along their lengths back from rotation. The blades 50, 52 are preferably also canted, as illustrated by FIG. 4. The inventors have found that canting the blades 50, 52 helps to bring fluid from the incoming axial direction to the radial output direction. In the depicted embodiment, both the long blades 50 and the shorter blades 52 are canted. In an alternative embodiment, the shorter blades 52 are not canted while the long blades 50 are canted. Alternatively, the shorter blades 52 might be canted but not curved while the long blades 50 are curved, but not canted. In the depicted embodiment, there are four long blades 50 and four shorter blades 52. However, there may be more or fewer than four of each type of blade 50 or 52.

In a particular embodiment, the impeller blade assembly 48 has two stages: an upper stage 56 and a lower stage 58. The upper stage 56 includes the shorter blades 52 and is located within the cupola 46 of the fluid housing 30. The lower stage 58 includes the long blades 50 and is located below the cupola 46.

In operation, a fluid jet 59 (FIG. 2) is created as the cutting blade 22 is rotated during cutting. Rotation of the cutting blade 22 rotates the impeller blade assembly 48 within the fluid housing 30. Rotation of the impeller blade assembly 48 draws fluid into the fluid chamber 32 through the fluid inlet 34 and flows fluid out through the fluid outlet 38. Rotation of the impeller blade assembly 48 imparts velocity to the fluid jet 59, allowing it to be effective in removing cuttings and debris from the cut 26.

Figure 6:
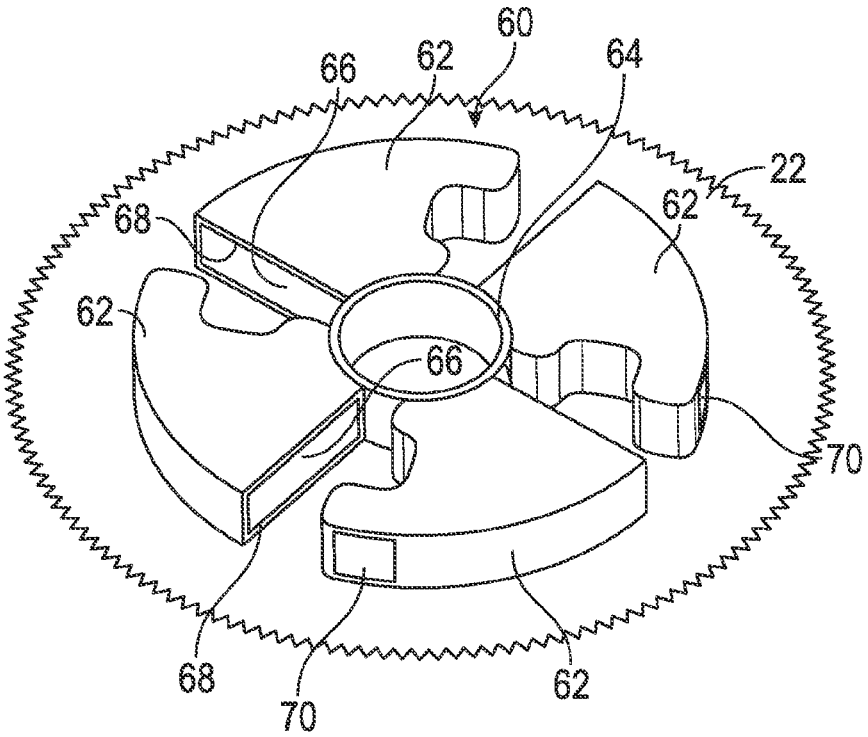
FIG. 6 is an external isometric view of an exemplary cutting blade which incorporates an alternative fluid jet generator in accordance with the present invention.
Figure 7:
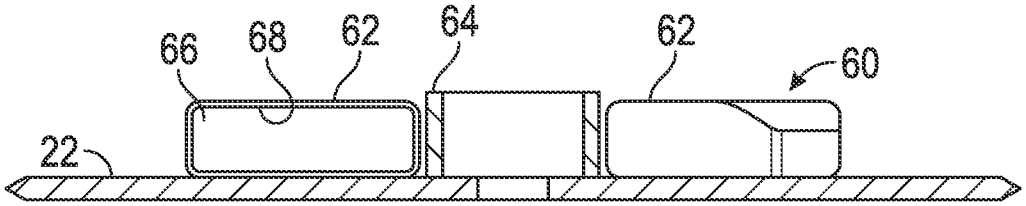
FIG. 7 is a side, cross-sectional view taken along lines 7-7 in FIG. 6.
Figure 8:
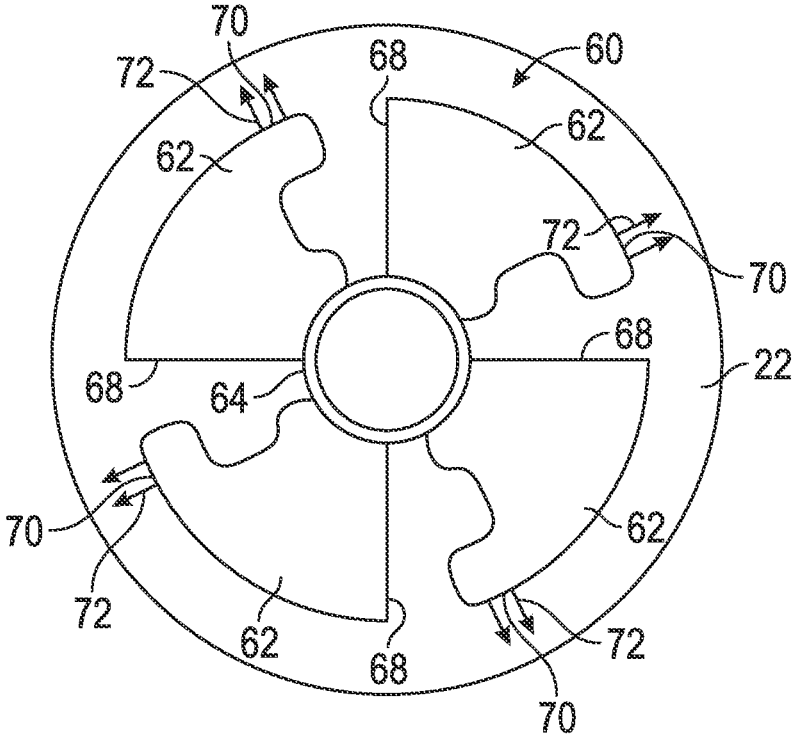
FIG. 8 is a top view of the fluid jet generator and cutting blade of FIGS. 6 and 7.

FIGS. 6-8 depict an alternative embodiment for a fluid jet generator 60 that is incorporated onto a cutting blade used in a pipe cutter. The exemplary fluid jet generator 60 includes four fluid collector/compressor lobes 62. However, there may be more or fewer than four such lobes, if desired. In the depicted embodiment, the lobes 62 are arranged around a center ring 64. Each of the lobes 62 defines a central fluid chamber 66. Each of the lobes 62 is provided with a fluid inlet 68 and a fluid outlet 70 that permit fluid to enter into and exit from the fluid chamber 66. It is noted that the fluid outlets 70 are oriented such that fluid exiting the fluid chamber 66 will be directed generally radially outwardly from the center of the fluid jet generator 60 (see FIG. 8). The fluid inlets 68 are preferably oriented in a direction normal to the radial direction. It is noted that the lobes 62 of the fluid jet generator 60 are preferably affixed to or mounted upon the cutting blade 22. Alternatively, the lobes 62 are not affixed to the blade 22 but will be rotated as the blade 22 is rotated.

In operation, rotation of the cutting blade 22 will generate fluid jets that are directed toward the cut 26 being made in the surrounding pipe 28. As the cutting blade 22 is rotated, fluid within the pipe 28 will be collected by the lobes 62. Fluid will flow into the fluid inlets 68 under the impetus of blade rotation and be compressed within the chamber 66. The fluid will exit the chambers 66 via the fluid outlets 70. The restricted flow area provided by the fluid outlets 70 increases the velocity of fluid passing through the outlets 70. Fluid jets 72 (see FIG. 4) are thereby formed and directed radially outwardly so that they aid in removing cuttings and debris from the area proximate the cut 26 during cutting.

It can be seen that the invention also provides methods for cutting a tubular member. According to an exemplary method of cutting, the pipe cutter 10, being equipped with either the fluid generator 24 or 60, is disposed within a tubular member 28 to be cut. The cutting blade 22 is then rotated to cut the tubular member 30. A fluid jet is created by the fluid jet generator 24 or 60 and directed toward the cut 26, thereby helping to remove cuttings from the cut. Preferably, incompressible fluids or liquids are used with the fluid jet generators 24, 60 of the present invention. Typical wellbore fluids include water, brines, and drilling muds.

Figure 9:
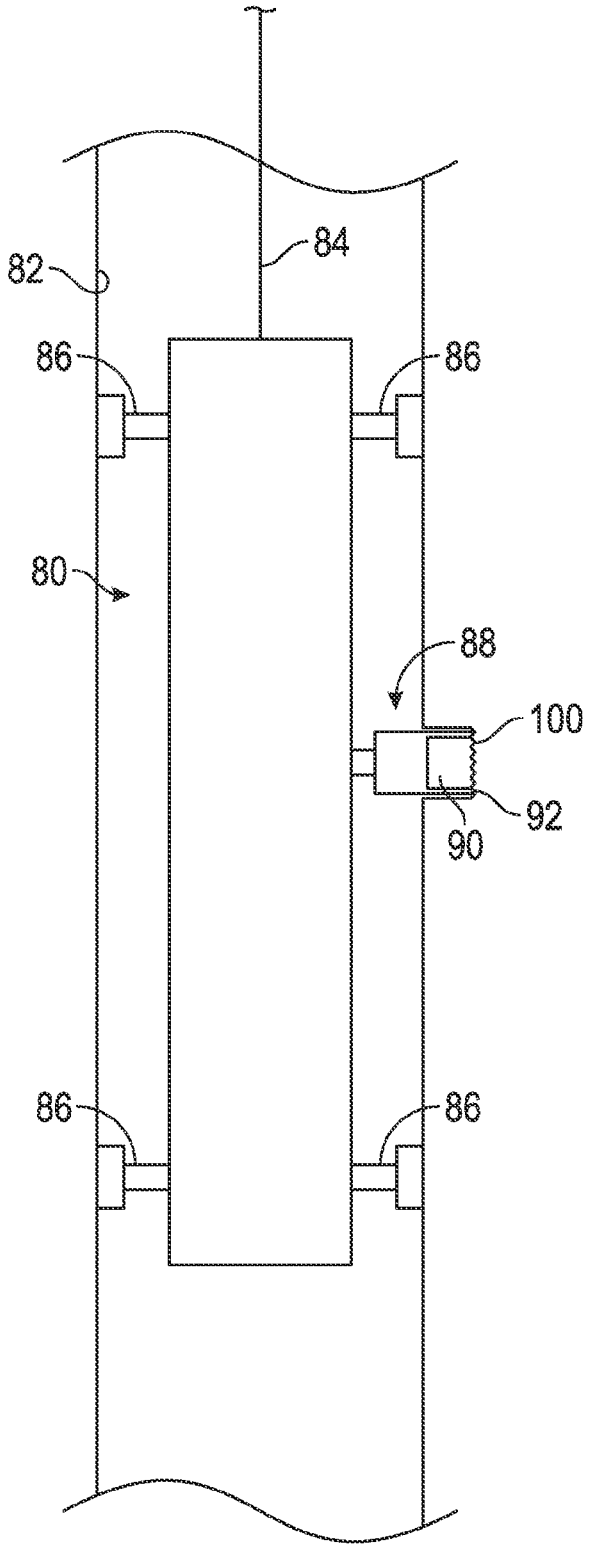
FIG. 9 is a side view of an exemplary side wall coring tool being used to cut a core sample in a borehole all.

FIG. 9 illustrates an exemplary sidewall coring tool 80 that has been disposed within a wellbore 82 by a wireline running arrangement 84. Stabilizers 86 help secure the coring tool 80 within the wellbore 82. A rotary coring cutter 88 extends radially outwardly from the coring tool 80 and is being rotated to cut a cylindrical core sample 90 in the wall of the wellbore 82 in a manner that is known in the art.

The rotary coring cutter 88 is shown only generally in FIG. 9. However, the coring cutter 88 incorporates a fluid jet generator in accordance with the present invention which directs fluid jets toward the circular cut 92 being made in the wall of the wellbore 82. The fluid jet generator may be of several different constructions in accordance with the present invention.

Figure 10:
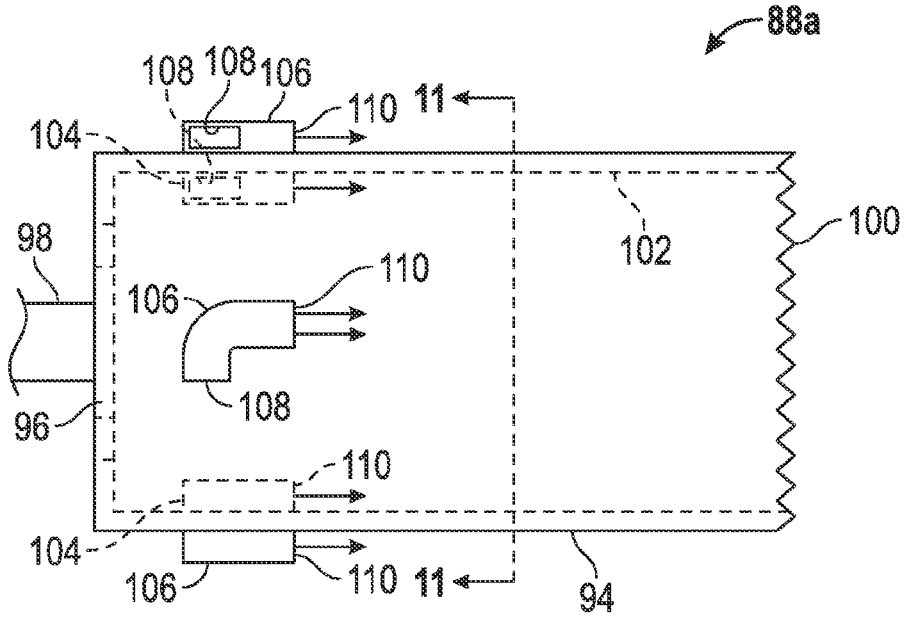
FIG. 10 is an external side view of an exemplary core cutting blade which incorporates a fluid jet generator in accordance with the present invention.
Figure 11:
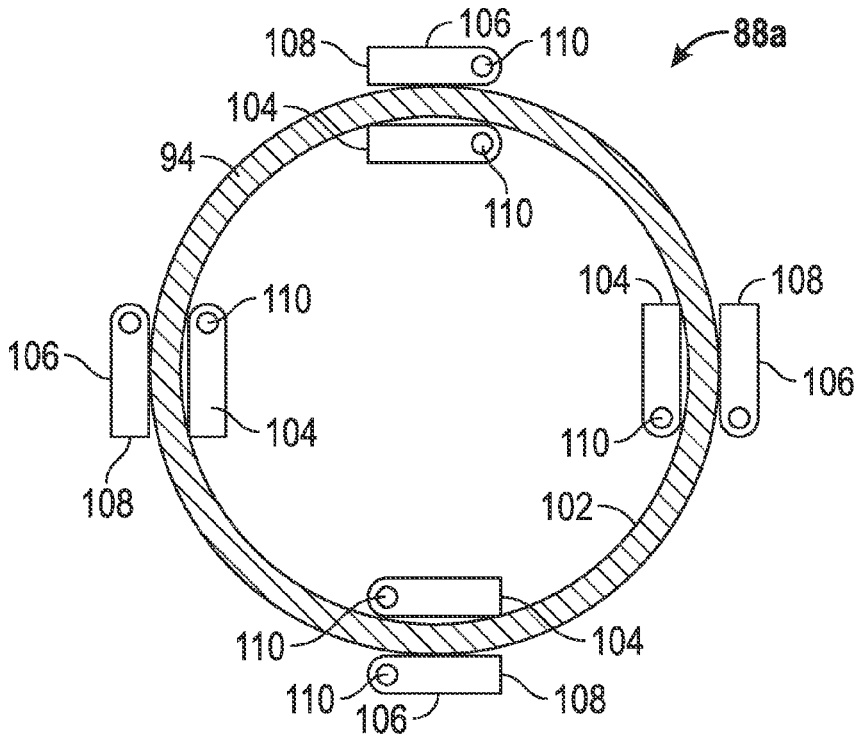
FIG. 11 is a cross-sectional view taken along lines 11-11 in FIG. 10.

FIGS. 10 and 11 illustrate a first embodiment for a fluid jet generator that is used in conjunction with coring cutter 88*a*. The coring cutter 88*a* is a generally cylindrical side all 94 with a closed axial end wall 96. A rotary shaft 98 is affixed to the closed axial end wall 96 and is used to rotate the cutter 88*a*. At the opposite axial end of the sidewall 94 from the closed axial end 96 is a toothed cutting edge 100. The sidewall 94 and axial end wall 96 define an interior chamber 102 that within which a cut core sample will reside as cutting occurs. The fluid jet generator in this instance is in the form of one or more collector/compressor lobes 104 that are located within the interior chamber 102 of the cutter 88*a*. In addition, collector/compressor lobes 106 are disposed upon the outer radial surface of the sidewall 94. In a manner similar to the lobes 62 described earlier, each of the lobes 104, 106 defines an interior chamber and has a fluid inlet 108 and a fluid outlet 110. The fluid outlets 110 have a smaller flow area than the fluid inlets 108 which provides an increase in fluid velocity. The fluid outlets 110 are directed toward the cutting edge 100 so that the resulting fluid jets are propagated in the direction of the cut being made as the cutter 88*a* is rotated. It is noted that, while there are lobes 104 and 106 shown disposed on both the interior and the exterior of the sidewall 94, there may, if desired, only be lobes on either the interior or exterior. Also, although four such lobes 104 and 106 are depicted, there may be more or fewer than four of each or of either.

Figure 12:
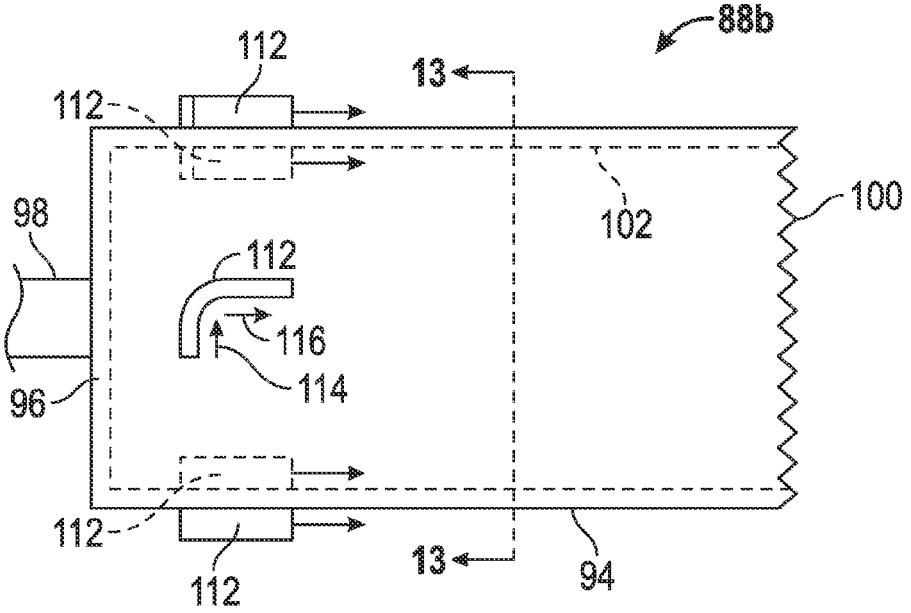
FIG. 12 is an external side view of an exemplary core cutting blade which incorporates an alternative fluid jet generator in accordance with the present invention.
Figure 13:
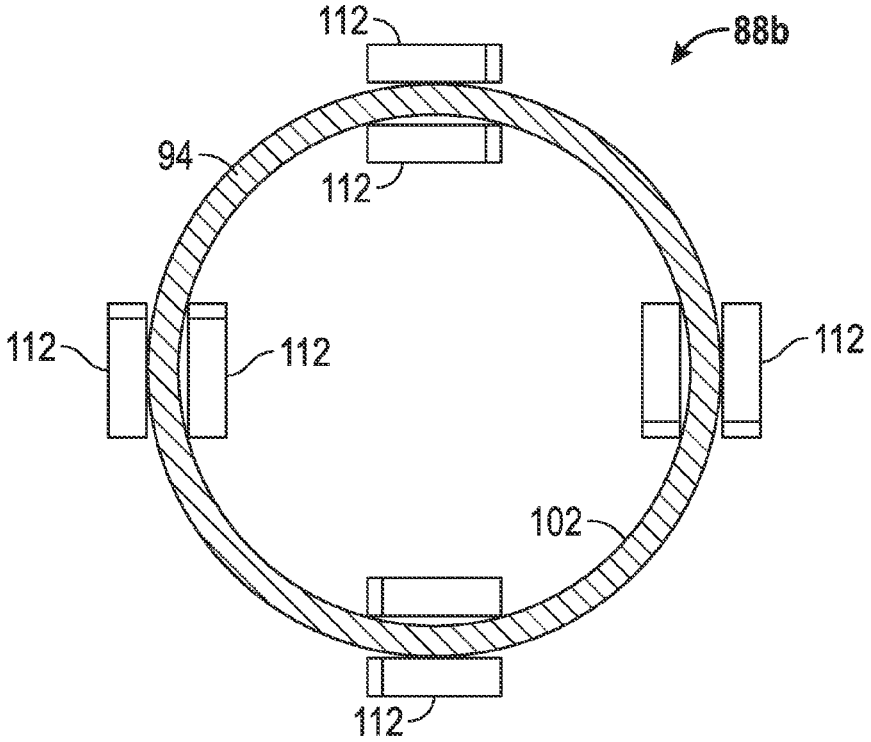
FIG. 13 is a cross-sectional view taken along lines 13-13 in FIG. 12.

FIGS. 12 and 13 depict an alternative embodiment for a fluid jet generator that is used in conjunction with coring cutter 88*b*. The coring cutter 88*b* is constructed and operates in the same manner as the coring cutter 88*a* except where indicated otherwise. In place of the collector/compressor lobes 104 and 106, curved fins 112 are affixed to both the interior and exterior of the sidewall 94. As the coring cutter 88*b* is rotated, fluid will approach each fin 112 in the angular direction indicated by arrow 114. The fin 112 will redirect the fluid in an axial direction, as indicated by arrow 116. As is apparent from FIG. 12, the resulting fluid jet is propagated in the direction of the cut being made by the cutting edge 100.

Figure 14:
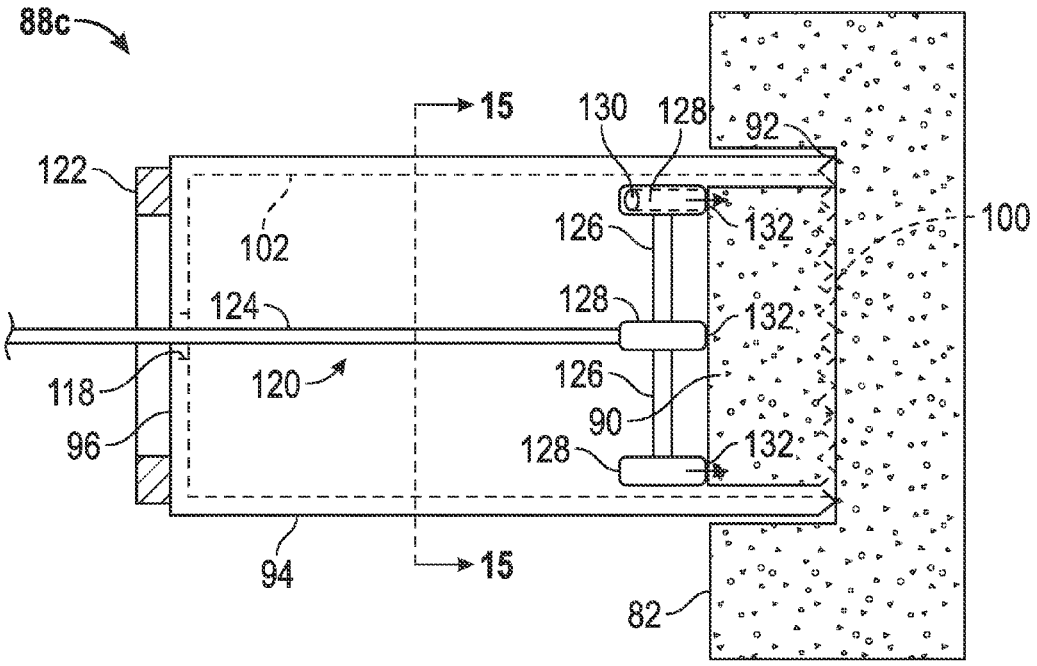
FIG. 14 is a side, cross-sectional view of a further exemplary core cutting blade which incorporates a further alternative fluid jet generator in accordance with the present invention.
Figure 15:
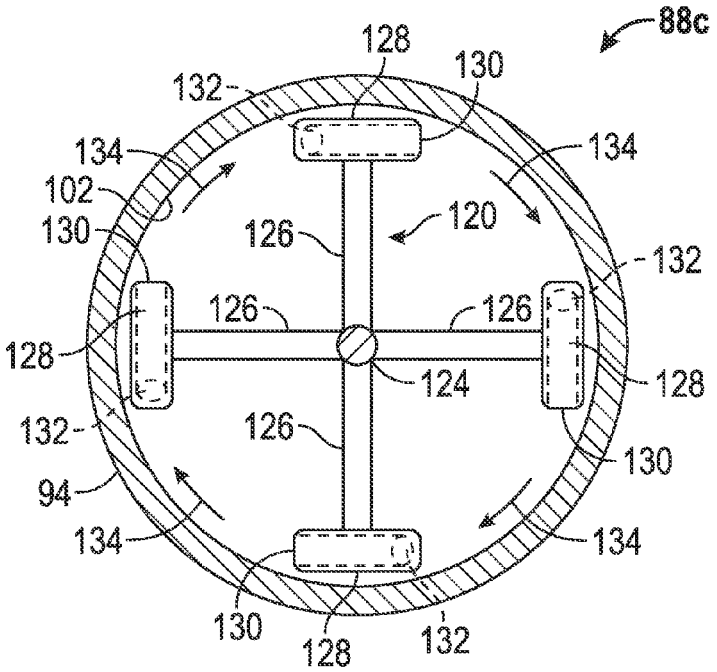
FIG. 15 is a cross-sectional view taken along lines 15-15 in FIG. 14.

FIGS. 14 and 15 illustrate a further alternative embodiment for a fluid jet generator that is used in conjunction with a coring cutter 88*c* to form cut 92 in the sidewall of the wellbore 82. The coring cutter 88*c* differs from the cutters 88*a* and 88*b* in that there is an opening 118 disposed through the axial end wall 94. In this embodiment, the coring cutter 88*c* is rotated independently from the jet forming component 120 by means of rotational ring 122. In other embodiments, the jet forming component 120 and the coring cutter 88*c* are interconnected and rotated together. The exemplary jet forming component 120 includes a central shaft 124 that is disposed through the opening 118 and is rotated by a motor (not shown). Radial spokes 126 extend outwardly from the distal end of the shaft 124. A jet forming mechanism 128 is located at the distal end of each spoke 126. Each of the jet forming mechanisms 128 is designed to create and direct a fluid jet toward the cut 92 as the shaft 124 of the jet forming component 120 is rotated. In the depicted embodiment, each jet forming mechanism 128 comprises a tube having a fluid inlet 130 that is oriented in the angular direction and a fluid outlet 132 that is oriented axially in the direction of the cut 92. As the jet forming component 120 is rotated in the direction indicated by arrows 134 in FIG. 15, fluid will enter the fluid inlet 130 of each jet forming mechanism 128 and be directed axially through the fluid outlet in the direction of the cut 92. As illustrated in FIG. 14, the jet forming mechanisms 128 of the component 120 are preferably placed into contact with the wellbore 82 during cutting to maximize the cleaning ability of the jet forming component 120.

Figure 16:
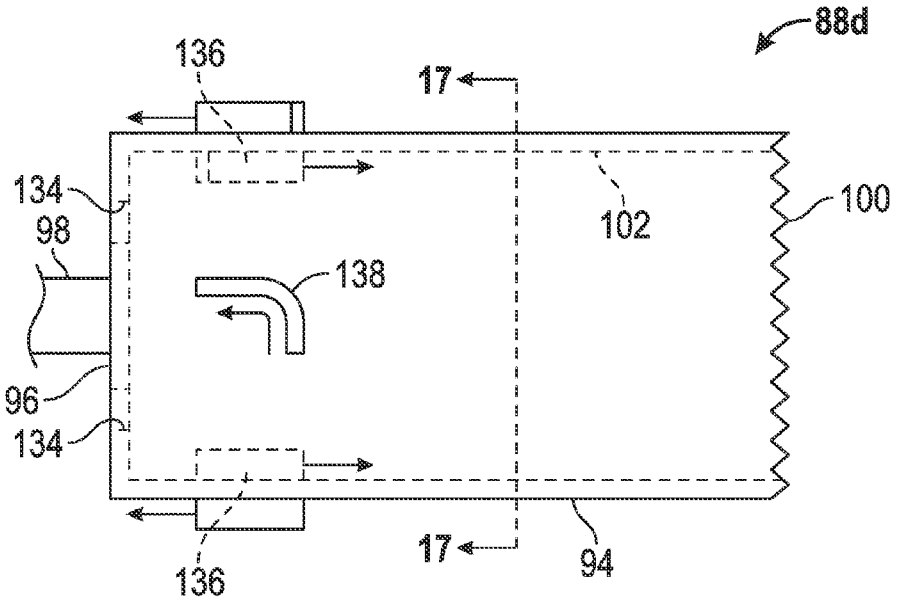
FIG. 16 is a side view of a further exemplary core cutting blade which incorporates a further alternative fluid jet generator in accordance with the present invention.
Figure 17:
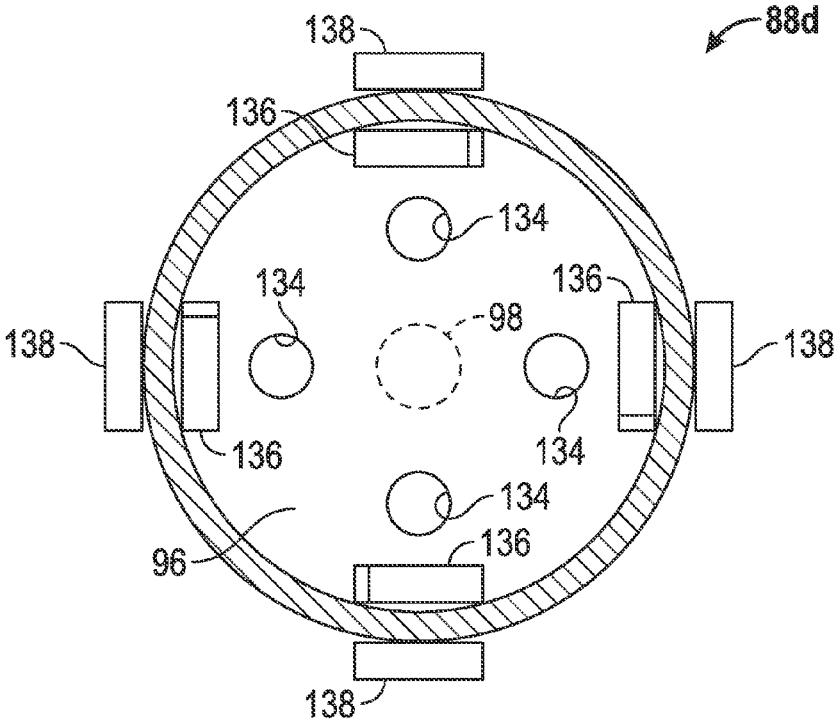
FIG. 17 is a cross-sectional view taken along lines 17-17 in FIG. 16.
Figure 18:
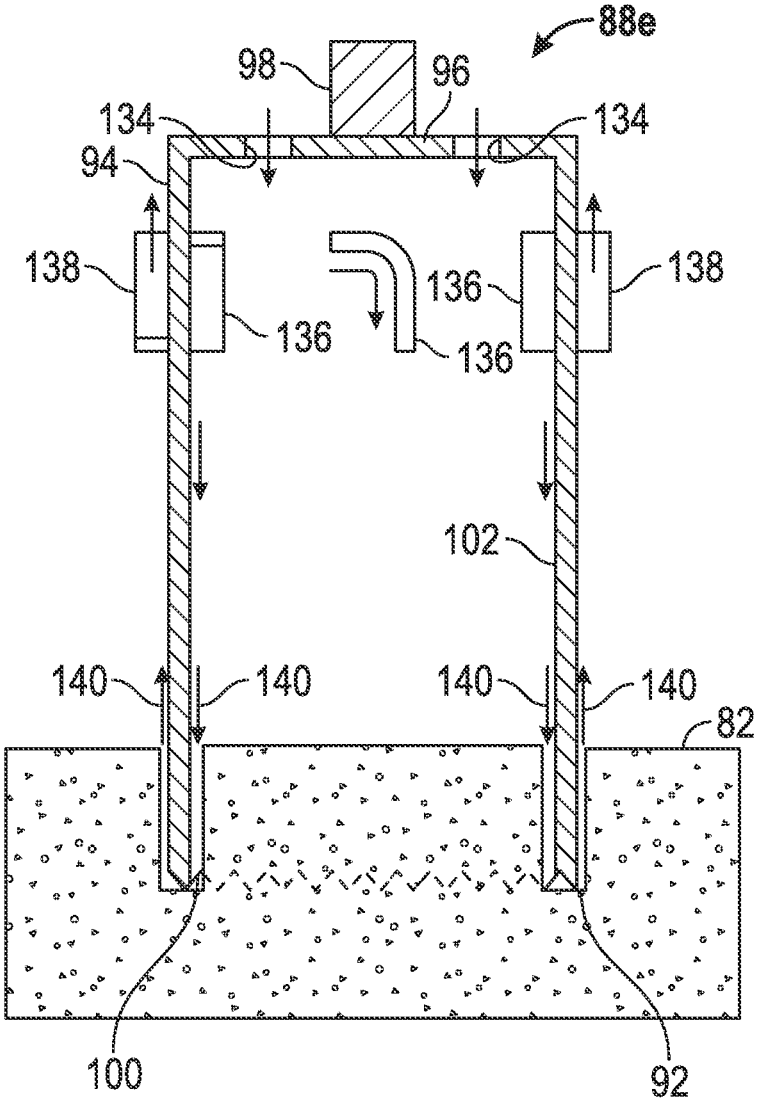
FIG. 18 is a cross-sectional view of the core cutting blade and fluid jet generator of FIGS. 16 and 17 now being used to cut a core sample in a wellbore side wall.

FIGS. 16-18 illustrate a further embodiment for a fluid jet generator that is used in conjunction with a coring cutter 88d to form cut 92 in the sidewall of the wellbore 82. The coring cutter 88d differs from the cutters 88a and 88b in that there are openings 134 disposed through the axial end wall 96 surrounding shaft 98. In the depicted embodiment, there are curved fins 136 disposed upon the radial interior of sidewall 94. The fins 136 are constructed and operate in the same manner as the fins 112 described earlier and function to direct fluid toward the cut 92, as FIG. 18 depicts. In addition, there are fins 138 disposed on the outer radial surface of the sidewall 94 of the cutter 88d. The curved fins 138 are oriented to direct fluid in the axial direction opposite from the fins 136 (i.e., away from cut 92. FIG. 18 illustrates that, during cutting, fluid flows through the openings 134 and into the interior chamber 102. The fins 136 will propagate fluid jets toward the cut 92 while the fins 138 will flow fluid away from the cut 92.

In operation during cutting, fluid is flowed toward the cut 92 by the fins 136 as the fins 138 flow fluid away, resulting in a circulation of fluid through the cut 92, as illustrated by arrows 140. It is noted that the fins 136 and 138 might also be interchanged, so that fins on the radial exterior of the sidewall 94 flow fluid toward the cut 92 while fins on the interior of the radial sidewall 94 flow fluid away from the cut 92.

Figure 19:
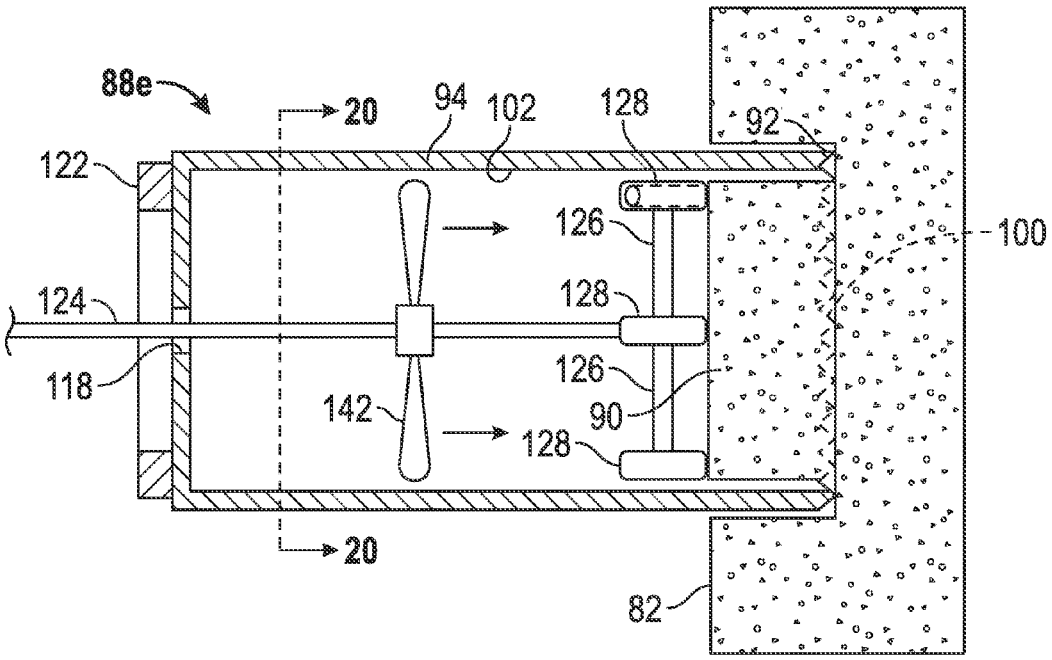
FIG. 19 is a side, cross-sectional view of a further exemplary core cutting blade which incorporates a further alternative fluid jet generator in accordance with the present invention.
Figure 20:
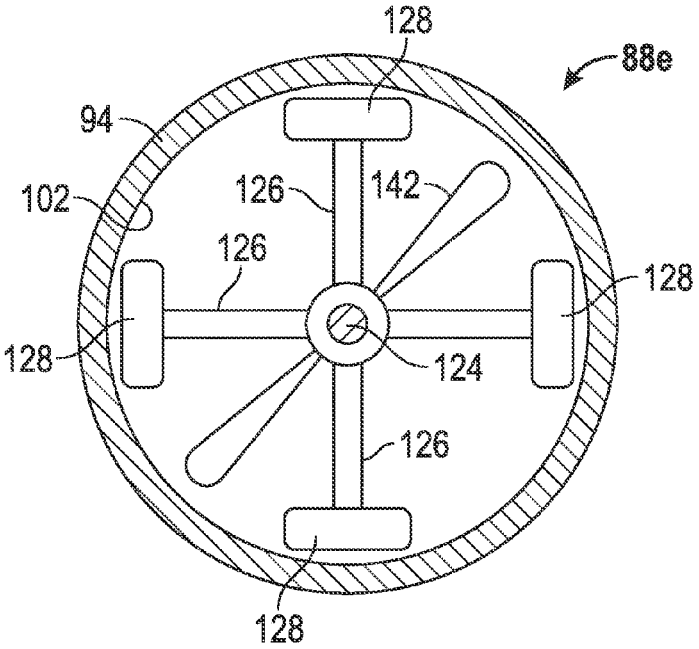
FIG. 20 is a cross-sectional view taken along lines 20-20 in FIG. 19.

FIGS. 19-20 depict a further embodiment for a fluid jet generator that is used in conjunction with a coring cutter 88*e*. In most respects, the fluid jet generator for this embodiment is constructed and operates in the same manner as the fluid jet generator depicted in FIGS. 14-15 and described above. However, a fluid impeller 142 is affixed to the shaft 124 above the jet forming mechanisms 128. In the depicted embodiment, the impeller 142 includes two blades designed to flow fluid in the direction of the cut 92 as the shaft 124 is rotated. Although only two blades are shown, those of skill in the art will understand that there may be more or fewer than two. The impeller 142 will increase fluid flow into and through the cut 92 during cutting.

Figure 21:
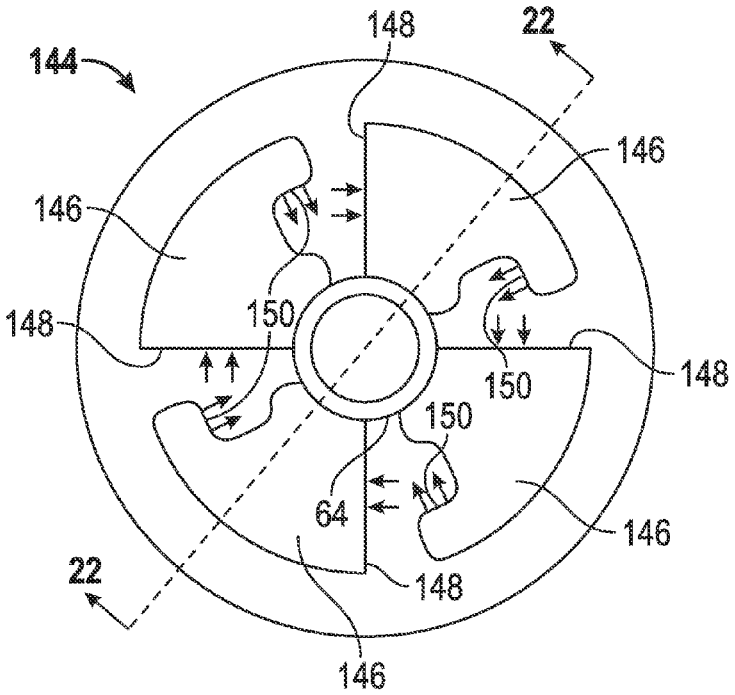
FIG. 21 is a side view of an exemplary flat circular cutter which incorporates a further alternative fluid jet generator in accordance with the present invention.
Figure 22:
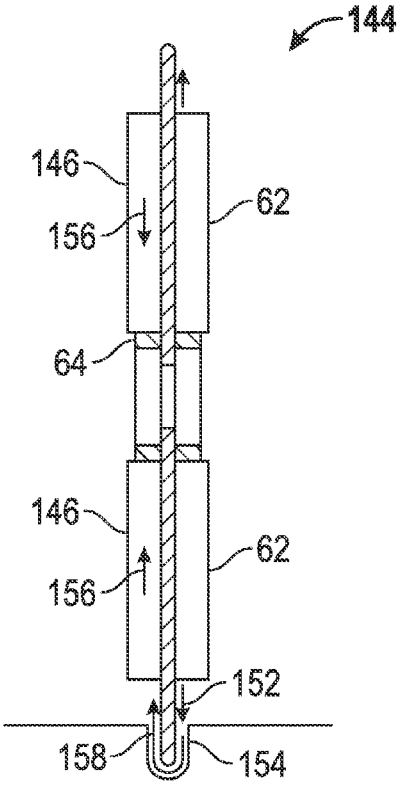
FIG. 22 is a cross-sectional view taken along lines 22-22 in FIG. 21.

FIGS. 21-22 illustrate an exemplary flat circular cutting blade 144 which incorporates a further embodiment for a fluid jet generator in accordance with the present invention. The blade 144 is constructed and operates in the same manner as the cutting blade 22 described earlier. One axial side of the cutting blade 144 is visible in FIG. 21. The opposite axial side of the blade 144 (which is not visible in FIG. 21) may have the same components and construction as the blade 22 shown in FIG. 8, such that the lobes 62 will direct fluid jets radially outwardly along the blade 22. Fluid collector/compressor lobes 146 are disposed upon the side of the cutting blade 144 which is visible in FIG. 21. The lobes 146 each have a fluid inlet 148 and a fluid outlet 150. The fluid outlets 150 are oriented to flow fluid entering each lobe 146 radially inwardly along the blade 144.

In operation, as depicted in FIG. 22, the lobes 62 generates fluid jets 152 toward a cut 154 being made in a work piece. At the same time, lobes 146 generate fluid jets 156 in a direction away from the cut 154. As a result, fluid will flow through the cut 154, as indicated by arrow 158, to assist in the removal of cutting from the cut 154.

Figure 23:
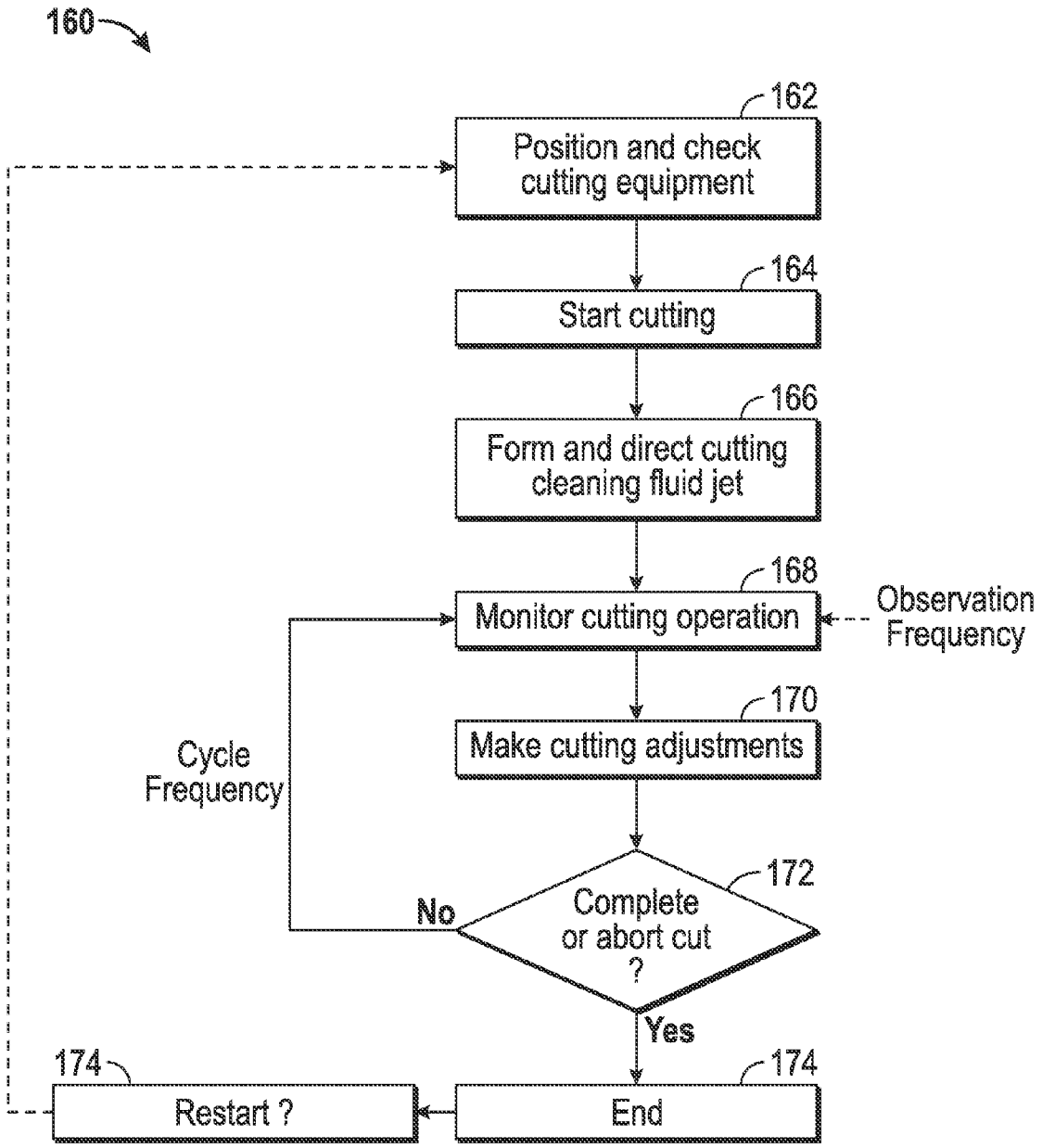
FIG. 23 is an operational cutting adjustment flow chart involving forced cut cleaning fluid flow.

Operation of rotary cutting tools having cutting blades in conjunction with associated fluid jet generators can be automated. The steps of automated cutting processes can be carried out using automated programmable controllers of a type known in the art. The controller is preferably pre-programmed with a desired cutting protocol for successful cutting of a workpiece. FIG. 23 is a flow chart illustrating an exemplary cutting operation 160. According to the first step 162 of the operation, the cutting equipment is positioned into a downhole environment and the equipment status and environmental conditions are checked. Thereafter, cutting starts in step 164 by rotating a cutting element and extending the rotating cutting element toward the target work piece. In step 166, a fluid jet is formed and directed according to methods described previously. In step 168, the cutting operation is monitored. This may be accomplished, depending upon the particular arrangement, by direct observation or indirect observation using cameras of a type known in the art or by the use of one or more sensors that sense at least one parameter associated with the cutting operation. Exemplary sensed parameters include pressure or cutting load, temperature, and blade position or angle. A user may select the desired observation frequency in accordance with this step. Adjustments can be made to the cutting operation (step 170) based upon either the observation or sensed parameter(s). For example, the surface power source level could be increased as cutting load increases due to cutting adjustments. Conversely, surface power source level could be reduced as cutting load decreases due to cutting adjustments. Details relating to the control and adjustment of electrical power supplied to downhole devices are described in U.S. Pat. No. 7,987,901 entitled "Electrical Control for a Downhole System" issued to Krueger et al. U.S. Pat. No. 7,987,901 is owned by the assignee of the present application and is incorporated herein in its entirety by reference.

Thereafter, a decision is made in step 172 either to complete the cutting operation or to abort the cutting operation. If a decision is made to abort the cutting operation ("Y"), the cutting operation is ended ("End" 174). If a decision is made to complete cutting ("N"), the operation 160 continues in an iterative or cyclical fashion with step 168 and carrying through to step 172, in accordance with a predetermined cycle frequency. If desired, the operation may have a step 174 wherein an aborted cutting operation is restarted with step 162.

It can be seen that the invention provides rotary cutting tools, including pipe cutter 10 and rotary coring cutter 88 having rotary cutters with self-cleaning fluid jets to clean cuts that are made in work pieces during cutting. Exemplary cutters are in the form of flat, circular cutting blades as well as coring cutters that have a generally cylindrical sidewall defining an interior chamber, a cutting edge at one axial end of the sidewall and an axial end wall opposite the cutting edge. The work pieces can be in the form of a tubular member or a wellbore sidewall.

Those of skill in the art will recognize that numerous modifications and changes may be made to the exemplary designs and embodiments described herein and that the invention is limited only by the claims that follow and any equivalents thereof.

What is claimed is:

1. A self-cleaning cutter for use in downhole cutting operations comprising:

a flat, circular rotary cutting blade to cut a work piece when rotated upon a spindle; and a fluid jet generator operably associated with the cutting blade to create a fluid jet directed toward a cut being made in the work piece as the cutting blade is rotated, the fluid jet generator comprising an impeller blade assembly which is affixed to and rotates with the rotary cutting blade to create the fluid jet.

2. The self-cleaning cutter of claim 1 wherein the fluid jet generator comprises a fluid housing that defines an interior fluid chamber, the housing having a fluid inlet and a fluid outlet, rotation of the impeller blade assembly with respect to the fluid housing flowing fluid into the fluid inlet and out of the fluid outlet.

3. The self-cleaning cutter of claim 2 wherein the fluid outlet is oriented to cause the fluid jet to be formed radially outwardly along the cutting blade.

4. The self-cleaning cutter of claim 2 wherein the fluid housing further comprises:

a substantially planar top plate; and a raised cupola.

5. The self-cleaning cutter of claim 1 wherein the impeller blade assembly has two stages.

6. The self-cleaning cutter of claim 1 wherein the impeller blade assembly comprises a plurality of blades extending radially outwardly along the cutting blade.

7. A method of cutting a work piece within a wellbore comprising the steps of:

rotating a flat, circular cutting blade upon a spindle to cut the work piece; and rotating an impeller blade assembly which is affixed to the cutting blade to rotate with the cutting blade to project a fluid jet to help remove cuttings from a cut being formed in the work piece.

8. The method of claim 7 wherein the method is conducted by an automated controller.

9. The method of claim 7 further comprising the steps of:

positioning a rotary cutting tool for rotating the cutting blade within the wellbore;

sensing at least one parameter associated with cutting; and adjusting the cutting based upon the sensed parameter.

* * * * *